United States Patent [19]

Trevathan

[11] 4,216,919

[45] Aug. 12, 1980

[54] MACHINE FOR COMMINUTING CLAY STOCK

[76] Inventor: Ellis F. Trevathan, P.O. Box 66, Gleason, Tenn. 38229

[21] Appl. No.: 29,138

[22] Filed: Apr. 11, 1979

[51] Int. Cl.[3] ..... B02C 18/22

[52] U.S. Cl. ..... 241/92; 241/167; 241/220

[58] Field of Search ..... 241/82, 92, 96, 167, 241/220, 273.2, 280

[56] References Cited

U.S. PATENT DOCUMENTS 3,528,617 9/1970 Trevathan ..... 241/92

*Primary Examiner*—Mark Rosenbaum

[57] ABSTRACT

A machine for comminuting clay stock. The machine includes a rotating body and a plurality of cutter blades attached to the body for rotation therewith. Clay stock is directed onto the body by a feed hopper. A non-rotating crowder mechanism is associated with the cutting blades to crowd portions of the clay stock against the rotating cutter blades whereby particles of clay are cut from the clay stock. A plurality of upwardly extending lugs are attached to the body for rotation therewith. A plurality of teeth members are attached to the crowder mechanism for coacting with the lugs to prevent rocks and the like from being crowded against the cutter blades.

10 Claims, 5 Drawing Figures

MACHINE FOR COMMINUTING CLAY STOCK

BACKGROUND OF THE INVENTION

1. Field of the Invention

This invention relates to devices for comminuting materials such as clay stock.

2. Description of the Prior Art

The following patents relate in general to the present invention: Bechtel, U.S. Pat. No. 557,472; Diesener, U.S. Pat. No. 644,795; Jacquart, U.S. Pat. No. 1,090,542; Jacquart, U.S. Pat. No. 1,136,676; Lind, U.S. Pat. No. 2,261,090; Trevathan, U.S. Pat. No. 3,528,617; and Bryant, U.S. Pat. No. 3,759,452. None of the above patents disclose or suggest the present invention.

The above cited Trevathan patent (U.S. Pat. No. 3,528,617) discloses a machine for comminuting clay stock which includes a rotary disc member having a plurality of cutter blades mounted thereon. A non-rotating crowder mechanism is associated with the disc member for forcing clay stock against the cutter blades as the disc member rotates whereby particles of clay are cut from the clay stock. A plurality of upwardly extending lugs are mounted on the disc member for rotation therewith to break chunks of hard clay material.

SUMMARY OF THE INVENTION

The present invention is directed towards improving upon prior methods of and machines for comminuting clay stock. The concept of the present invention is to provide a clay stock comminuting machine of the type having a crowder means for crowding clay stock against rotating cutter blade means with coacting lug means and teeth means for preventing non-comminutable material from being forced against the cutter blade means by the crowder means.

The machine of the present invention includes a rotating body means; a plurality of cutter blade means attached to the body means for rotation therewith; a feed hopper means for directing clay stock onto the body means; a crowder means for crowding portions of the clay stock against the cutter blade means to cause particles of clay to be cut from the clay stock; a plurality of upwardly extending lug means attached to the body means for rotation therewith, at least a plurality of the lug means having a forwardly directed, downwardly sloping face surface; and a plurality of teeth means attached to the crowder means for coacting with the plurality of lug means to prevent any non-comminutable substance contained in the clay stock greater than a predetermined size from being crowded against the cutter blade means by the crowder means, at least a plurality of the teeth means having a rearwardly directed, downwardly sloping face surface.

DESCRIPTION OF THE PREFERRED EMBODIMENT

Figure 1:
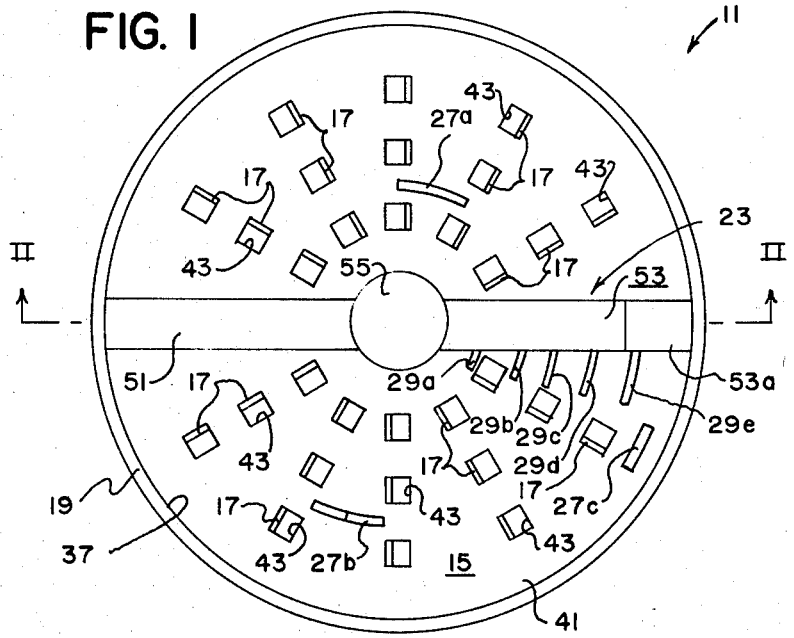
FIG. 1 is a top plan view of the machine of the present invention.

The machine 11 of the present invention is for comminuting clay stock. That is, when clay stock is first mined it is normally in large chunks and may include impurities such as rocks and the like of various sizes. One step in the processing of such mine clay stock is that of comminuting or disintegrating the clay stock into small particles. It will be noted that the machine 11 of the present invention is basically of the same general construction as that disclosed in the above cited Trevathan patent (U.S. Pat. No. 3,528,617). That is, the machine 11 includes a rotor means 13, the rotor means 13 including a rotating body means 15 and including a plurality of cutter means 17 attached to the body means 15; a feed hopper means 19 for directing clay stock 21 onto the body means 15; and crowder means 23 for crowding portions of the clay stock 21 against the cutter blade means 17 to cause particles 25 of clay to be cut from the clay stock 21. While these components may be constructed in various manners, the disclosure of the above cited Trevathan patent (U.S. Pat. No. 3,528,617) can be referred to for one preferred manner of specifically constructing these components.

The present invention includes a plurality of upwardly extending lug means 27 attached to the body means 15 for rotation therewith and includes a plurality of teeth means 29 attached to the crowder means 23 for coacting with a plurality of the lug means 27 to prevent any non-comminutable substance such as rocks 31 or the like contained in the clay stock 21 greater than a predetermined size from being crowded against the cutter blade means 17 by the crowder means 23 to thereby prevent possible damage to the machine 11. At least a plurality of the lug means 27 have a forwardly directed, downwardly sloping face surface 33. By "forwardly directed," it is meant that the face surfaces 27 slope downwardly in the direction that the body means 15 rotates. At least a plurality of the teeth means 29 have a rearwardly directed, downwardly sloping face surface 35. By "rearwardly directed," it is meant that the face surface 35 slope downwardly in a direction opposite the rotation of the body means 15.

The feed hopper means 19 defines an upwardly directed opening 37 and may consist of a ring-like member rigidly supported by appropriate structure 39 which may consist of the body or rigid supporting framework of the machine 11 and as disclosed by the above cited Trevathan patent (U.S. Pat. No. 3,528,617).

The body means 15 may consist of a disc-like member having an upper or face surface 41 and having a plurality of through apertures 43 therein. Each cutter blade means 17 is associated with one of the apertures 43. That is, cutter blade means 17 is attached to the body means 15 in a position for extending through one of the apertures 43 with the cutting edge 45 of each cutter blade means 17 extending above the face surface 41. It should be noted that the size of the aperture 43 determines in part the size of the particles 25 of clay stock 21 that are produced by the machine 11. That is, by reducing the size of the apertures 43, the average size of the particles 25 of clay stock 21 produced by the machine 11 will be correspondingly smaller, as will be apparent to those skilled in the art. It should be noted that the body means 15 may be constructed in a framework like manner including an open, spoke-like frame onto which various size plates can be removably attached to vary the size of the openings between the spokes and thereby vary the average size of the particles of clay stock produced by the machine 11.

The body means 15 is rotatably supported beneath the upwardly directed opening 37 defined by the feed hopper means 19 in any manner apparent to those skilled in the art. For example, the structure 39 may include roller members 47 for engaging the outer periphery 49 of the body means 15 to thereby support the body means 15. Additional support for the body means 15 may be provided by a pair of struts 51, 53 and a bearing assembly 55 with the bearing assembly 55 attached to the center of the body means 15 and with each strut 51, 53 extending between the bearing assembly 55 and the wall of the feed hopper means 19 whereby the bearing assembly 55 is fixedly attached to the feed hopper means 19 and rotatably supports the body means 15.

The body means 15 may be rotated in any manner apparent to those skilled in the art. For example, the body means 15 may be rotated in the same manner as disclosed in the above cited Trevathan patent (U.S. Pat. No. 3,528,617). On the other hand, the bearing assembly 55 may include a motor means for causing the body means 15 to rotate.

A funnel shaped conical chute 57 is preferably stationarily arranged beneath the body means 15 for receiving the particles 25 of the clay stock 21 that pass through the apertures 43 and for directing such particles 25 to a conveyor belt or receptable structure (not shown). The conical chute 57 may be fixedly supported by the structure 39.

The crowder means 23 may be of substantially the same basic construction as disclosed in the above cited Trevathan patent (U.S. Pat. No. 3,528,617). That is, the crowder means 23 may include three angularly disposed crowder-breaker bars 59, 61, 63 secured subjacently to the radially extending strut 53. Each crowder-breaker bar 59, 61, 63 has a forwardly directed, downwardly sloping lower surface 65 for crowding the clay stock 21 against the cutting edges 45 of the cutter blade means 17. By forwardly directed and downwardly sloping, it is meant that the lower surfaces 65 slope towards the face surface 41 of the body means 15 in the direction which the body means 15 is rotating.

Figure 2:
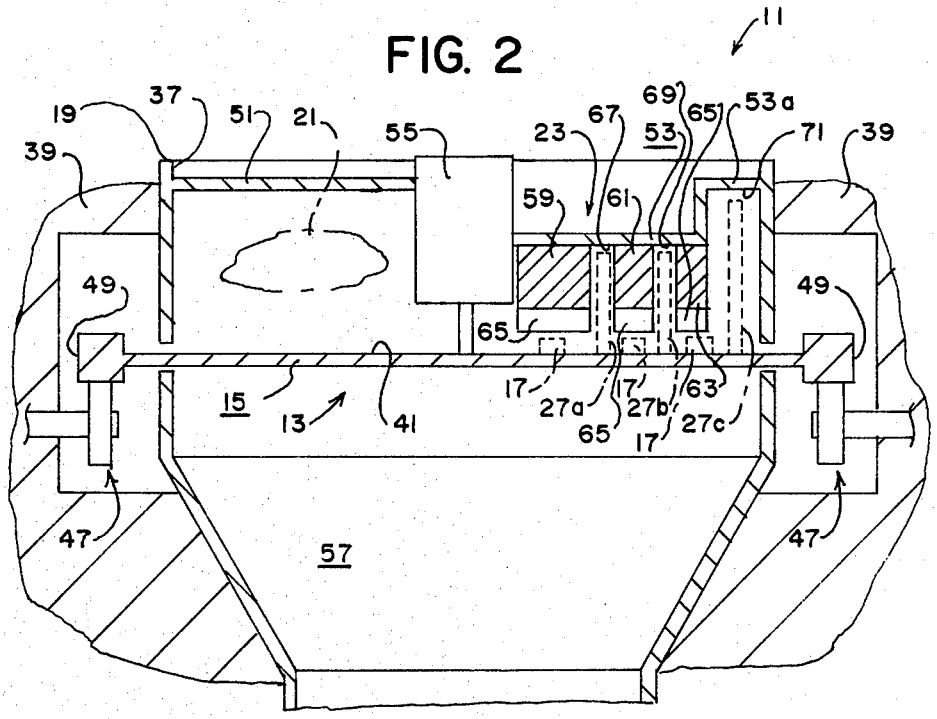
FIG. 2 is a sectional view as taken on line II—II of FIG. 1 with some parts shown in moved, broken line positions and with other parts removed for clarity.

The machine 11 includes at least two lug means *27a, 27b* with forwardly directed, downwardly sloping face surfaces 33 and includes at least five teeth means *29a, 29b, 29c, 29d, 29e* with rearwardly directed, downwardly sloping face surface 35. The lug means *27a, 27b* are spaced radially apart from one another. More specifically, the machine 11 preferably includes three lug means *27a, 27b, 27c* is shown in FIG. 1 with the lug means spaced radially apart from one another. That is, the lug means *27a* is located substantially near the center of the body means 13, the lug means *27c* located substantially adjacent the outer periphery 49 of the body means, and the lug means *27b* is positioned radially substantially equal distance between the lug means *27a, 27c* (see FIGS. 1 and 2). It should be noted that the lug means *27c* preferably extends upward from the face surface 41 of the body means 15 a greater distance than the lug means *27a, 27b* and does not include a forwardly directed, downwardly sloping face surface 33. The lug means *27c* acts to scrape built-up deposits of clay material from the wall of the feed hopper means 19 and the like for reasons which should be apparent to those skilled in the art in view of the above cited Trevathan patent (U.S. Pat. No. 3,528,617). The strut 53 preferably includes an offset portion 53*a* to accommodate the lug means *27c*. By thus radially spacing the lug means 27, the lug means *27a* will rotate through the space 67 between the crowder-breaker bars 59, 51 when the body means 15 rotates, the lug means *27b* will rotate through the space 69 between the crowder-breaker bars 61, 63 when the body means 15 rotates, and the lug means *27c* will rotate through the space 71 between the crowder-breaker bar 63 and the wall of the feed hopper means 19 when the body means 15 rotates.

Figure 4:
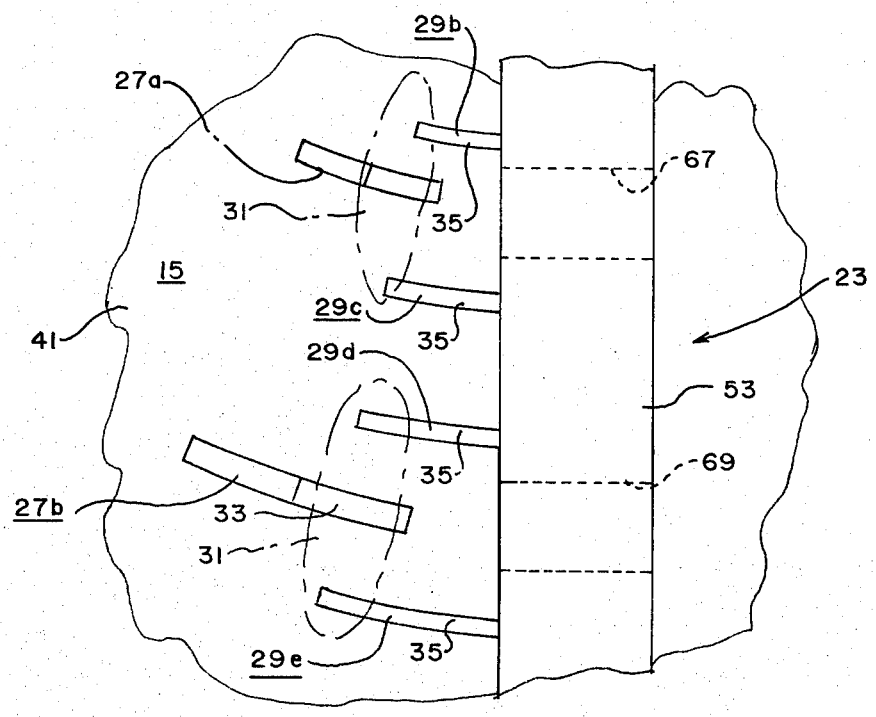
FIG. 4 is a top plan view of a portion of the machine of the present invention.

The lug means *27a, 27b, 27c* are preferably spaced angularly apart from one another. More specifically, the lug means *27a, 27b, 27c* are preferably spaced substantially 120° apart from one another as clearly shown in FIG. 1. The teeth means 29 are preferably spaced radially apart from one another as clearly shown in FIG. 1 with the teeth means *29a* located substantially close to the center of the body means 15 with the teeth means *29e* located substantially adjacent to the wall of the feed hopper means 19 and with the remaining teeth means *29b, 29c, 29d* spaced radially substantially equal distance between the teeth means *29a, 29e*. In this manner, the lug means *27a, 27b* rotates by the teeth means 29 substantially intermediate two of the teeth means 29. More specifically, the lug means *27a* rotates by the teeth means 29 substantially intermediate the teeth means *29b, 29c* and the lug means *27b* rotates by the teeth means 29 substantially intermediate the teeth means *29d, 29e* (see FIG. 4). The longitudinal axis of each of the lug means 27 is preferably curved an amount corresponding to the radial distance each lug means 27 is spaced from the rotating center axis of the body means 15. Likewise, the longitudinal axis of each of the teeth means 29 is preferably curved an amount portional to the radial distance each of the teeth means 27 is spaced from the rotating center axis of the body means 15.

The size of the non-comminutable substance (e.g., the rocks 31) that is prevented from being crowded against the cutter blades means 17 by the crowder means 23 is determined in part by the spacing of the teeth means 29 above the face surface 41 of the body means 15 and by the spacing of the teeth means 29 radially apart from one another. That is, by spacing the teeth means 29 closer to the face surface 41 of the body means 15 and/or by spacing the teeth means 29 radially closer to one another, the size of the non-comminutable substance prevented from being crowded against the cutter blade means 17 by the crowder means 23 is reduced.

Figure 3:
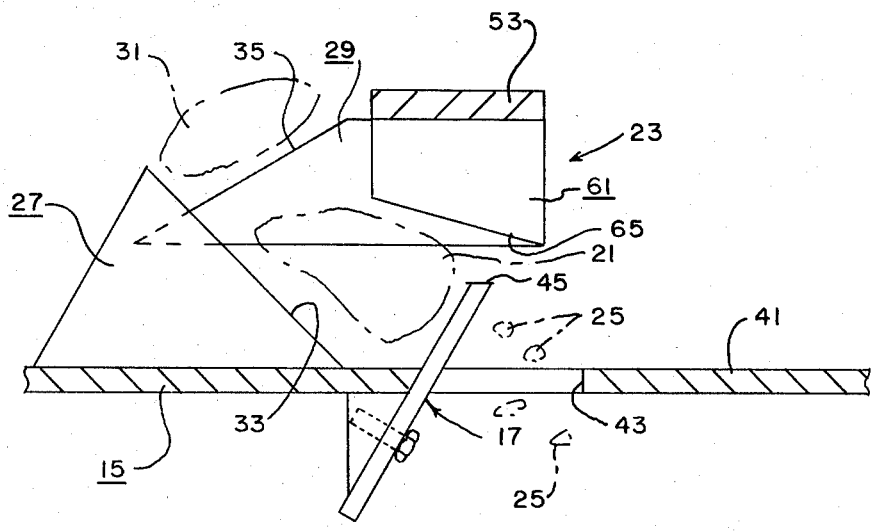
FIG. 3 is a sectional view of a portion of the machine of the present invention.

The operation of the machine 11 is as follows: clay stock 21 is introduced into the feed hopper means 19 in any manner apparent to those skilled in the art. The feed hopper means 19 directs the clay stock onto the rotating body means 15. The rotation of the body means 15 causes the clay stock 21 to engage the crowder means 23 whereby the clay stock 21 will be forced against the cutter blade means 17 and particles 25 of clay will be cut therefrom by the cutting edges 45 of the cutter blade means 17. Any non-comminutable substance in the clay stock 21 such as rocks 31 that will not pass beneath the teeth means 29 or between two adjacent teeth means 29 will be prevented from reaching the crowder means 23 and will be forced upon the face surfaces 33, 35 of the lug means 27 and teeth means 29 as clearly shown in FIGS. 3 and 4. The rocks 31 can be manually removed from the machine 11 after the clay stock 21 has been thoroughly comminuted and after the body means 15 stops rotating.

Figure 5:
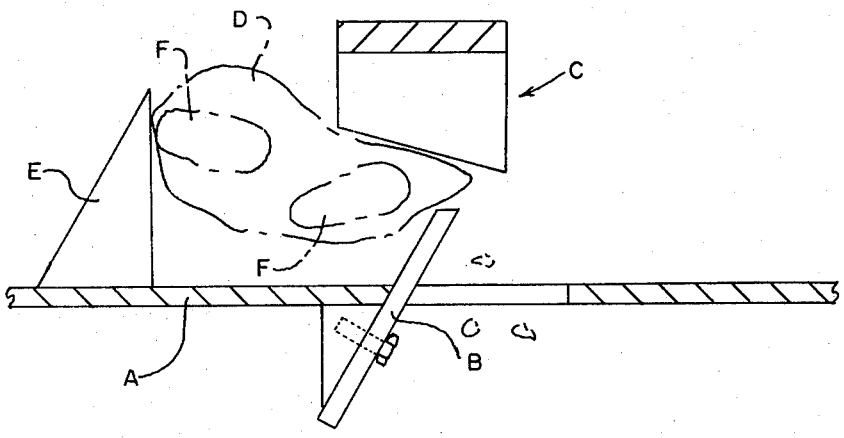
FIG. 5 (PRIOR ART)
FIG. 5 is a sectional view similar to FIG. 3 but showing a prior art machine.

FIG. 5 shows the relevant structure of a prior art clay stock comminuting machine including a rotating body means A, cutter blade means B attached to the rotating body means A, crowder means C for crowding clay stock D against the cutter blade means B, and lug means E attached to the rotating body means A for coacting with the crowder means B to break chunks of hard clay stock. As should be clear from FIG. 5, any non-comminutable substance such as rocks F in the clay stock B that will pass under the crowder means C will be forced against the cutter blade means B thereby possibly causing damage to the machine.

Although the invention has been described and illustrated with respect to a preferred embodiment thereof, it is not to be so limited since changes and modifications may be made therein which are within the full intended scope of the invention.

I claim:

1. An improved machine for comminuting clay stock, said machine including a rotor means, said rotor means including a rotating body means and including a plurality of cutter blade means attached to said body means, said machine including a feed hopper means for directing clay stock onto said body means and including crowder means for crowding portions of said clay stock against said cutter blade means to cause particles of clay to be cut from said clay stock, wherein the improvement comprises: a plurality of upwardly extending lug means attached to said body means of said rotor means for rotation therewith; and a plurality of teeth means attached to said crowder means for coacting with said plurality of lug means to prevent any non-comminutable substance contained in said clay stock greater than a predetermined size from being crowded against said cutter blade means by said crowder means; a plurality of said lug means having a face surface; a plurality of said teeth means having a face surface, said face surface of said lug means being directed in the direction of rotation of said body means and sloping towards said body means, said face surface of said teeth means being directed opposite the direction of rotation of said body means and sloping towards said body means.

2. The improvement of claim 1 in which is included at least two of said lug means having said forwardly directed, downwardly sloping face surface; and in which is included at least five of said teeth means having said rearwardly directed, downwardly sloping face surface.

3. The improvement of claim 1 in which each of said lug means rotates by said teeth means substantially intermediate two of said teeth means.

4. The improvement of claim 3 in which said lug means are spaced radially apart from one another.

5. The improvement of claim 4 in which said lug means are spaced angularly apart from one another.

6. The improvement of claim 5 in which said teeth means are spaced radially apart from one another.

7. The improvement of claim 6 in which each of said lug means has a longitudinal axis and is spaced a radial distance from the rotating axis of said frame means, and in which said longitudinal axis of each of said lug means is curved an amount corresponding to the radial distance said lug means is spaced from the rotating axis of said frame means.

8. The improvement of claim 7 in which each of said teeth means has a longitudinal axis and is spaced a radial distance from the rotating axis of said frame means, and in which said longitudinal axis of each of said teeth means is curved an amount proportional to the radial distance said teeth means is spaced from the rotating axis of said frame means.

9. The improvement of claim 1 in which the spacing of said teeth means above said body means and the spacing of said teeth means radially apart from one another determines in part the size of said non-comminutable substance prevented from being crowded against said cutter blade means by said crowder means.

10. A machine for comminuting clay stock, said machine comprising:

(a) a rotor means, said rotor means including a rotating body means having an upper surface and having a plurality of through apertures therein, said rotor means including means for causing said body means to rotate, said rotor means including a plurality of cutter blade means attached to said body means and extending above said upper surface of said body means, each of said cutter blade means being associated with one of said apertures in said body means;

(b) feed hopper means for directing clay stock onto said upper surface of said body means;

(c) crowder means located above a portion of said upper surface of said body means for crowding portions of said clay stock directed onto said upper surface of said body means against said cutter blade means to cause particles of clay to be cut from said clay stock and to pass through said apertures in said body means;

(d) a plurality of upwardly extending lug means attached to said upper surface of said body means for rotation therewith, each of said lug means having a forwardly directed, downwardly sloping face surface; and (e) a plurality of teeth means attached to said crowder means for coacting with said lug means to prevent any non-comminutable substance present in said clay stock of a size greater than a predetermined maximum from being crowded against said cutter blade means by said crowder means, each of said teeth means having a rearwardly directed, downwardly sloping face surface.

* * * * *